US008939547B2

(12) United States Patent
Kida et al.

(10) Patent No.: US 8,939,547 B2
(45) Date of Patent: Jan. 27, 2015

(54) RECORDING APPARATUS

(75) Inventors: Akira Kida, Yokohama (JP); Masahiro Sugimoto, Yokohama (JP); Masaharu Ueda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 471 days.

(21) Appl. No.: 12/965,102

(22) Filed: Dec. 10, 2010

(65) Prior Publication Data

US 2011/0279541 A1 Nov. 17, 2011

(30) Foreign Application Priority Data

May 17, 2010 (JP) ..... 2010-113560

(51) Int. Cl.

| | |
|---|---|
| ***B41J 2/165*** | (2006.01) |
| ***B41J 2/515*** | (2006.01) |
| ***B41J 25/34*** | (2006.01) |
| *B41J 11/00* | (2006.01) |

(52) U.S. Cl.

CPC *B41J 2/515* (2013.01); *B41J 25/34* (2013.01); *B41J 11/0025* (2013.01)

USPC ..... 347/40

(58) Field of Classification Search

None

See application file for complete search history.

(56) References Cited

U.S. PATENT DOCUMENTS

| | | | | |
|---|---|---|---|---|
| 7,278,700 | B2 | 10/2007 | Yamaguchi et al. | |
| 7,677,719 | B2 * | 3/2010 | Nakashima et al. | 347/104 |
| 2006/0044331 | A1 * | 3/2006 | Tsutsumi et al. | 347/5 |
| 2006/0170732 | A1 * | 8/2006 | Yamada | 347/49 |

FOREIGN PATENT DOCUMENTS

| | | | |
|---|---|---|---|
| JP | 2005-349660 | A | 12/2005 |

* cited by examiner

*Primary Examiner* — Alejandro Valencia

(74) *Attorney, Agent, or Firm* — Canon USA Inc. IP Division

(57) ABSTRACT

A holder that holds a line recording head is displaced in a sheet width direction against the urging force of an elastic portion to bring an abutment portion of the holder into contact with one of a plurality of positioning surfaces provided at a reference portion of a sheet conveying mechanism. The holder is positioned and fixed to the reference portion, with the urging force exerted thereto.

5 Claims, 14 Drawing Sheets

RECORDING APPARATUS

BACKGROUND OF THE INVENTION

1. Field of the Invention

The present invention relates to a recording apparatus having a line recording head.

2. Description of the Related Art

A recording apparatus having a line recording head that covers the maximum record width of a sheet requires to support not only sheets having a maximum size but also sheets of various widths. Using a sheet having a small width for a long time causes unbalance in frequency of use of the recording elements of a line recording head. The life of elements that are used frequently becomes short, thus causing imperfect recording correspondingly.

Japanese Patent Laid-Open No. 2005-349660 (refer to FIG. 1) discloses a recording apparatus having a configuration in which the region of ink nozzles to be used can be moved by displacing a line recording head along a sheet width direction, although having no awareness about the above problem.

In Japanese Patent Laid-Open No. 2005-349660, the mechanism for displacing the line recording head uses a rotary motor and an endless belt. However, the endless belt is not suitable for correct positioning because the endless belt generally has elasticity. Unless correct positioning is performed when displacing the line recording head, an image recording position deviates. To prevent it, a correct positioning mechanism that causes no displacement during use is needed.

SUMMARY OF THE INVENTION

The present invention is made in view of the above problem. The present invention provides a recording apparatus having a mechanism capable of correct positioning by displacing a line recording head in a sheet width direction.

The present invention provides an apparatus including a conveying mechanism configured to convey a sheet in a first direction; a line recording head in which nozzles are arrayed along a second direction intersecting the first direction in a plane parallel to a sheet surface in a recording position; a holder configured to hold the line recording head, the holder having an abutment portion; a displacement mechanism configured to displace the holder at least in the second direction and having a fixed portion and a movable portion; an elastic portion provided between the movable portion and the holder and configured to exert an urging force in the second direction; and a reference portion having a plurality of positioning surfaces that differ in the second direction and that can come into contact with the abutment portion. When the line recording head is to be positioned in the second direction, the holder is displaced in the second direction against the urging force of the elastic portion using the displacement mechanism to bring the abutment portion into contact with one of the positioning surfaces, thereby positioning and fixing the holder to the reference portion, with the urging force exerted thereto.

With a recording apparatus according to an aspect of the present invention, the unbalance of the use frequency of nozzles of a line head can be reduced by displacing the line recording head in the sheet width direction, thereby allowing high-quality image recording for a long period. Since displacement of the recording head is accurate and no positional misalignment occurs during use, images can be recorded at accurate positions for a long period.

Further features of the present invention will become apparent from the following description of exemplary embodiments with reference to the attached drawings.

DESCRIPTION OF THE EMBODIMENTS

Figure 1:
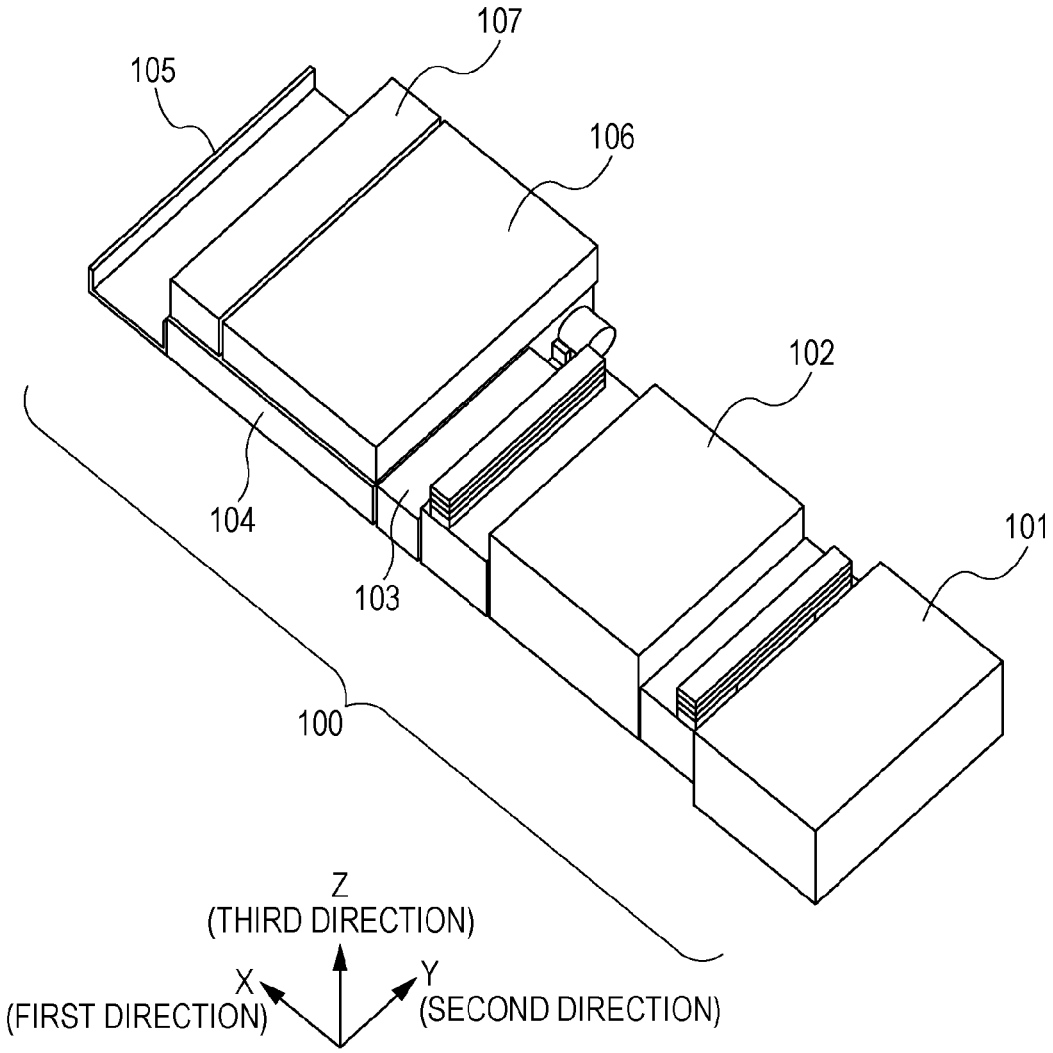
FIG. 1 is a diagram illustrating the overall configuration of a recording apparatus according to an embodiment of the present invention.

FIG. 1 is a perspective view illustrating the overall configuration of a recording apparatus according to an embodiment of the present invention. A recording apparatus 100 includes a sheet supply unit 101, a recording unit 102, a cutter unit 103, a drying unit 104, and a discharging unit 105 from the upstream side to the downstream side of a sheet conveying direction during recording. An ink tank unit 106 and a control unit 107 are provided on the drying unit 104. Any position in a sheet conveying path close to the sheet supply unit 101 is referred to as an upstream position, and a position opposite thereto is referred to as a downstream position. The sheet supply unit 101 rotatably holds a rolled continuous sheet (roll sheet). In this embodiment, the sheet, which is a recording medium, is a continuous sheet; it may be a cut sheet. The sheet supply unit 101 has a feed mechanism for drawing out a sheet to feed the sheet downstream in the sheet conveying direction (X-direction, also referred to as a first direction). The continuous sheet supplied from the sheet supply unit 101 is printed with a plurality of images by the recording unit 102 and is then cut into a unit length by the cutter unit 103. The cut sheet is dried by the drying unit 104 and is discharged to the discharging unit 105. The control unit 107 is a controller responsible for controlling and driving the entire recording apparatus 100 and includes a CPU, a memory, and various I/O interfaces.

Figure 2:
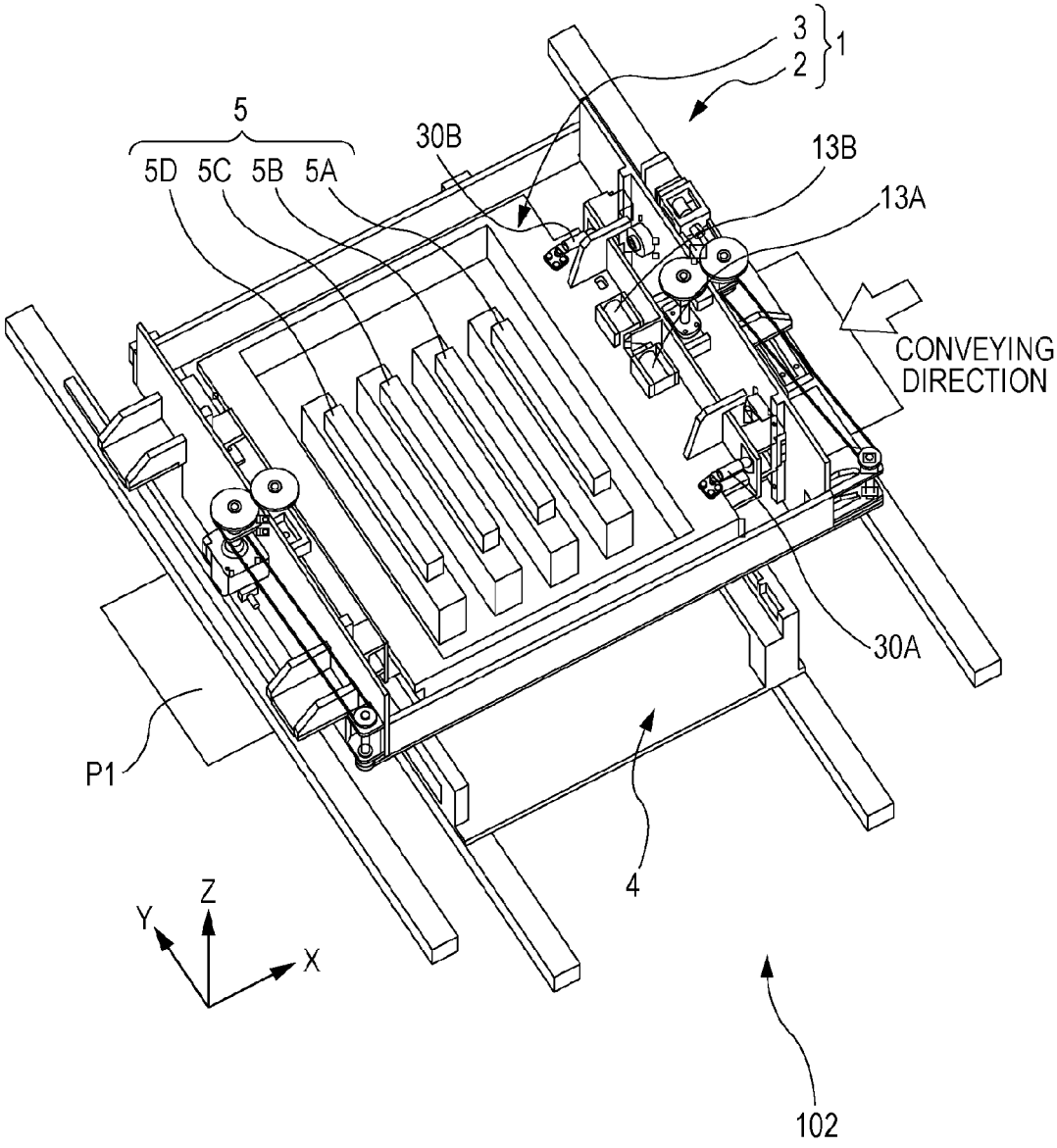
FIG. 2 is diagram illustrating the configuration of a recording unit.

FIG. 2 is a perspective view illustrating the configuration of the recording unit 102 in FIG. 1. The recording unit 102 accommodates a plurality of recording head units 5 (5A to 5D) corresponding to different ink colors. The recording head units 5 each include a recording head having a nozzle surface on which an ink nozzle array is formed. The plurality of recording head units 5A to 5D are integrally held by a head holder 3. The color inks are held in the ink tank unit 106 and are supplied to the respective recording head units 5 through ink tubes. The recording head units 5 do not necessarily each have separate a ink tank but may have a configuration in which a recording head and an ink tank are integrated. Although this embodiment includes four recording head units corresponding to four CMYK colors, the number of colors is not limited thereto. Each of the plurality of recording head units 5 is a line recording head in which an inkjet nozzle array is formed in a range in which a supposed maximum sheet width is covered. The arranging direction of the ink nozzle array is a sheet widthwise direction, that is, a Y-direction (second direction) intersecting the X-direction (in this embodiment, at right angles) in a plane parallel to the sheet surface at a recording position. The ink nozzle array may be either an array in which nozzle chips are arranged regularly, such as in a staggered pattern, formed across the whole area in the widthwise direction or an array formed in a line along the widthwise direction. The inkjet system can employ a system that uses heating elements, a system that uses piezoelectric elements, a system that uses electrostatic elements, a system that uses MEMS elements, etc.

The recording unit 102 further accommodates a displacement mechanism 2 and a conveying mechanism 4. The displacement mechanism 2 is a mechanism for displacing the head holder 3 in a predetermined direction with respect to fixed frames 78 of the recording apparatus. The displacement mechanism 2 and the head holder 3 constitute a recording head portion 1. The conveying mechanism 4 is a mechanism for conveying a sheet P1 in the conveying direction (X-direction) in the recording unit 102.

Figure 3A:
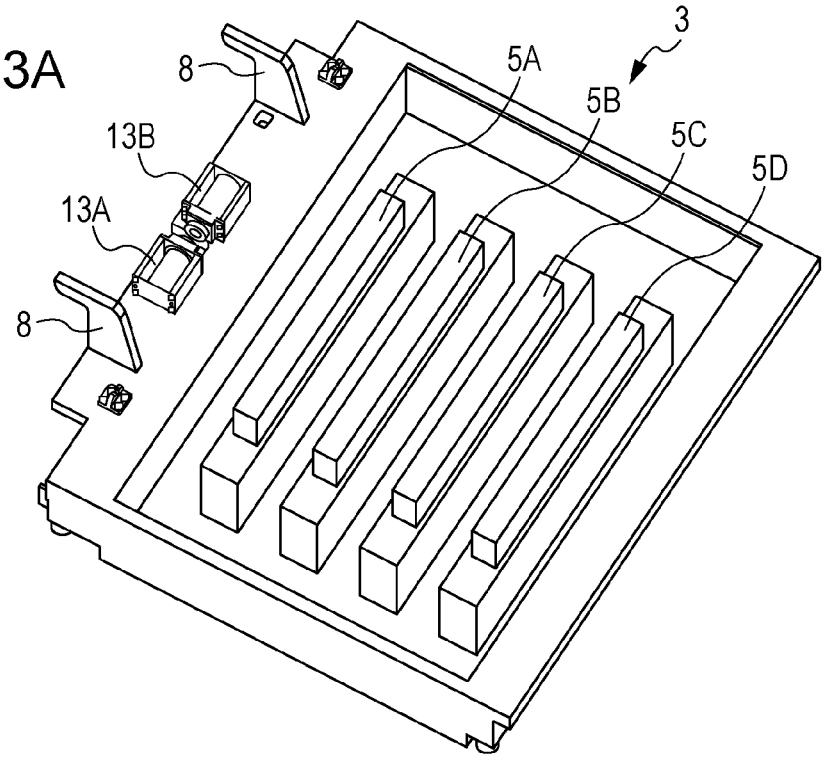
FIG. 3A is a diagram of a head holder as viewed from diagonally above.
Figure 3B:
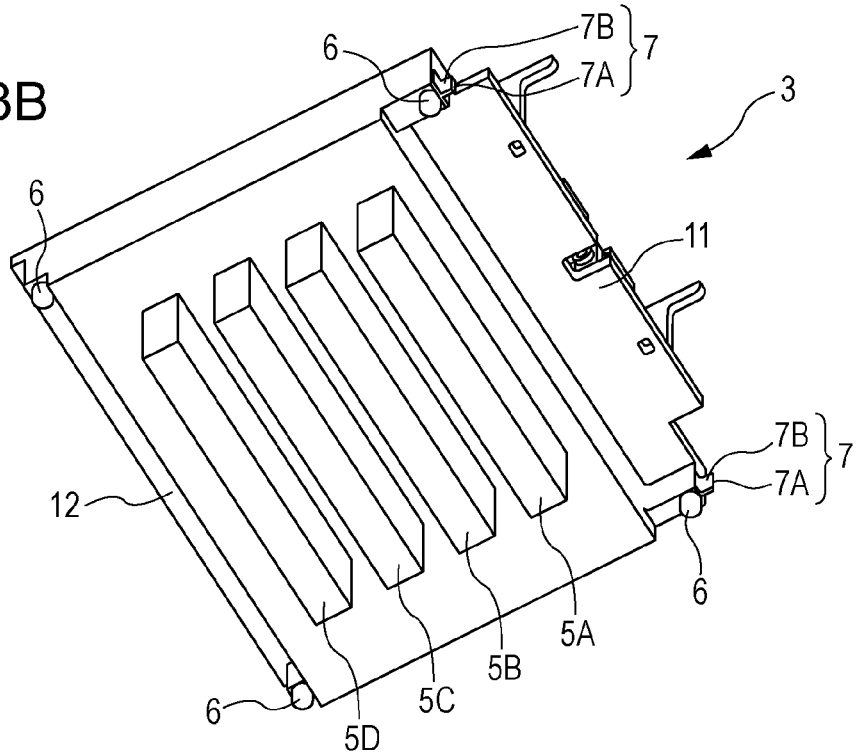
FIG. 3B is a diagram of the head holder as viewed from diagonally below.

FIGS. 3A and 3B are perspective views illustrating the configuration of the head holder 3. FIG. 3A is a diagram of the head holder 3 as viewed from diagonally above, and FIG. 3B is a diagram of the head holder 3 as viewed from diagonally below. As shown in FIG. 3A, two ribs 8 and two elastic portions 13A and 13B are formed along the Y-direction on the upper surface of the head holder 3. The ends of the ribs 8 come into contact with part of the displacement mechanism 2 in the X-direction. The two elastic portions 13A and 13B are opposed to each other at a predetermined interval therebetween and come into contact with part of the displacement mechanism 2 in the Y-direction. As shown in FIG. 3B, two ribs 7 (abutment portions) and four Z-bearings 6 (abutment portions) are formed on the lower surface of the head holder 3. The ribs 7 each have an X-surface 7A (first abutment portion) that comes into contact with part of reference portions having the same reference as those of the fixed portions of the conveying mechanism 4 in the X-direction and a Y-surface 7B (second abutment portion) that is in contact with part of the reference portions in the Y-direction. The Z-bearings 6 (third abutment portions) are in contact with part of the reference portions of the conveying mechanism 4 in a Z-direction (referred to as a third direction) that is a direction of a gap between the nozzles and the sheet. The Z-bearings 6 are rolling bearings whose reference-portion contact portions of the conveying mechanism have a rotatable spherical shape. Furthermore, flat portions 11 and 12 are formed on the lower surface of the head holder 3.

Figure 4:
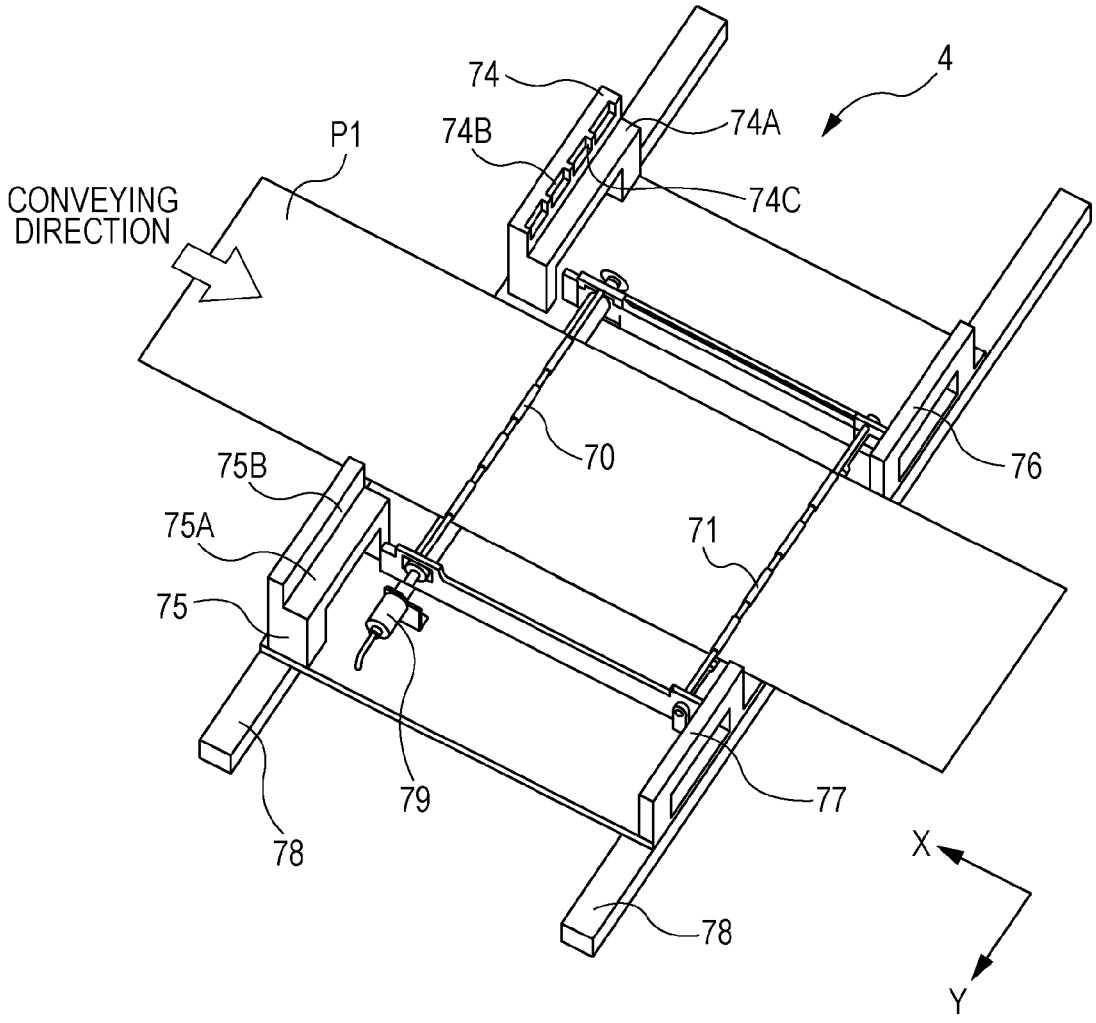
FIG. 4 is a perspective view illustrating the configuration of a conveying mechanism.

FIG. 4 is a perspective view illustrating the configuration of the conveying mechanism 4. The conveying mechanism 4 is provided with reference to the fixed frames 78 of the recording apparatus. The conveying mechanism 4 includes main conveying roller pairs 70 and secondary conveying roller pairs 71 to convey the sheet P1 in the recording unit. The main conveying roller pairs 70 are given a rotational driving force by a driving motor 79. The rotation is transmitted to the secondary conveying roller pairs 71 through a pulley and a belt to rotate the secondary conveying roller pairs 71 in synchronization therewith. The reference portion provided with the same reference as that of the fixed portion of the conveying mechanism 4 (the fixed portion provided with reference to the fixed frames 78 of the recording apparatus) has four reference blocks 74 to 77 that come into contact with part of the head holder 3. The reference block 74 has a plurality of small depressions of the same shape along the Y-direction. The depressions each have, inside thereof, an X-positioning surface 74B (first positioning surface) that comes, as a bottom, into contact with the X-surface 7A of the rib 7, and has, as sides, a plurality of Y-positioning surfaces 74C (second positioning surfaces) that come into contact with the Y-surfaces 7B of the rib 7. The reference block 74 further has a Z-positioning surface 74A (third positioning surface) that comes into contact with the Z-bearing 6 of the head holder 3. The reference block 75 has a Z-positioning surface 75A (third positioning surface) that comes into contact with the Z-bearing 6 of the head holder 3 and an X-positioning surface 75B (first positioning surface) that comes into contact with the X-surface 7A of the rib 7. The upper surfaces of the reference blocks 76 and 77 are contact surfaces (third positioning surfaces) to the Z-bearings 6. The X-positioning surfaces 74B and the X-positioning surfaces 75B of the depressions are arranged in a straight line along the Y-direction.

Figure 5:
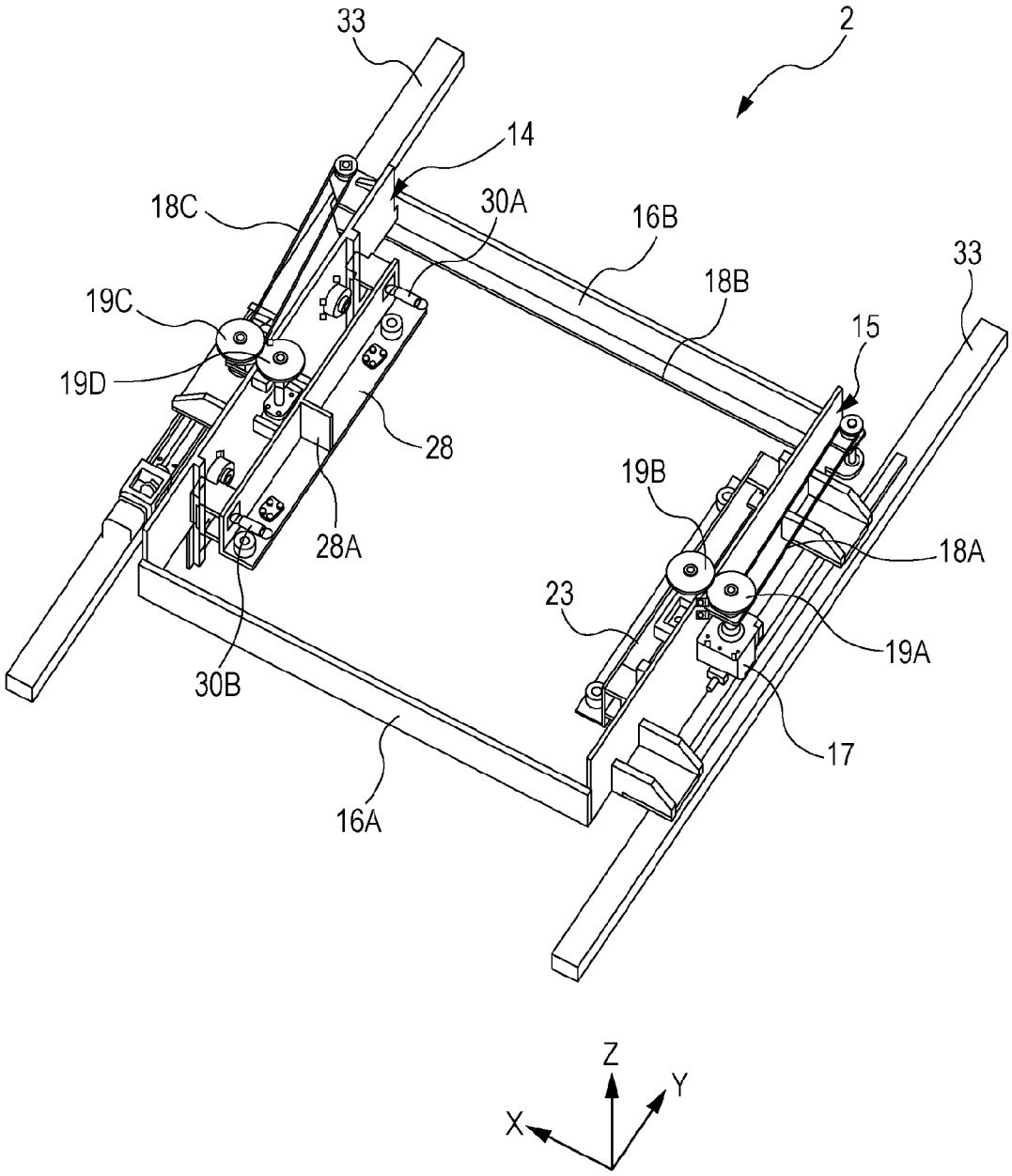
FIG. 5 is a perspective view illustrating the configuration of a displacement mechanism.

FIG. 5 is a perspective view illustrating the configuration of the displacement mechanism 2. The displacement mechanism 2 is a mechanism having a fixed portion and a movable portion for moving the head holder 3 in the Z-direction and the Y-direction with reference to the fixed frames 78 of the recording apparatus.

A Z-converting mechanism for moving the head holder 3 in the Z-direction will be described. This includes a moving frame constituted of frames 14 and 15 that support a Z-driving portion for moving the head holder 3 in the Z-direction and joint portions 16A and 16B that joins them. The moving frame can move straight in the Y-direction with respect to fixed frames 33, as will be described later. The Z-driving portion moves the head holder 3 in the Z-direction with respect to the moving frame. The head holder 3 is supported in the Z-direction with respect to the moving frame via two Z-arms 23 and 28. The Z-arms 23 and 28 constitute the movable portion of the displacement mechanism 2, and the other components constitute the fixed portion. The Z-arm 28 has a plate 28A, at the center in the Y-direction, as part of the Z-arm 28. The Z-driving portion is constituted by a motor 17, belts 18A to 18C, and gears 19A to 19D. When the motor 17 rotates in the normal or reverse direction, the rotation of the motor 17 is transmitted via the gears 19A and 19B to move the Z-arm 23 upward and downward with a ball screw mechanism provided at the frame 15, thereby moving the head holder 3 upward or downward in the Z-direction. At the same time, the rotation of the motor 17 is transmitted via the belts 18A to 18C and the gears 19C and 19D to move the Z-arm 28 vertically with a ball screw mechanism provided at the frame 14, thereby moving the head holder 3 upward or downward in the Z-direction.

Figure 6:
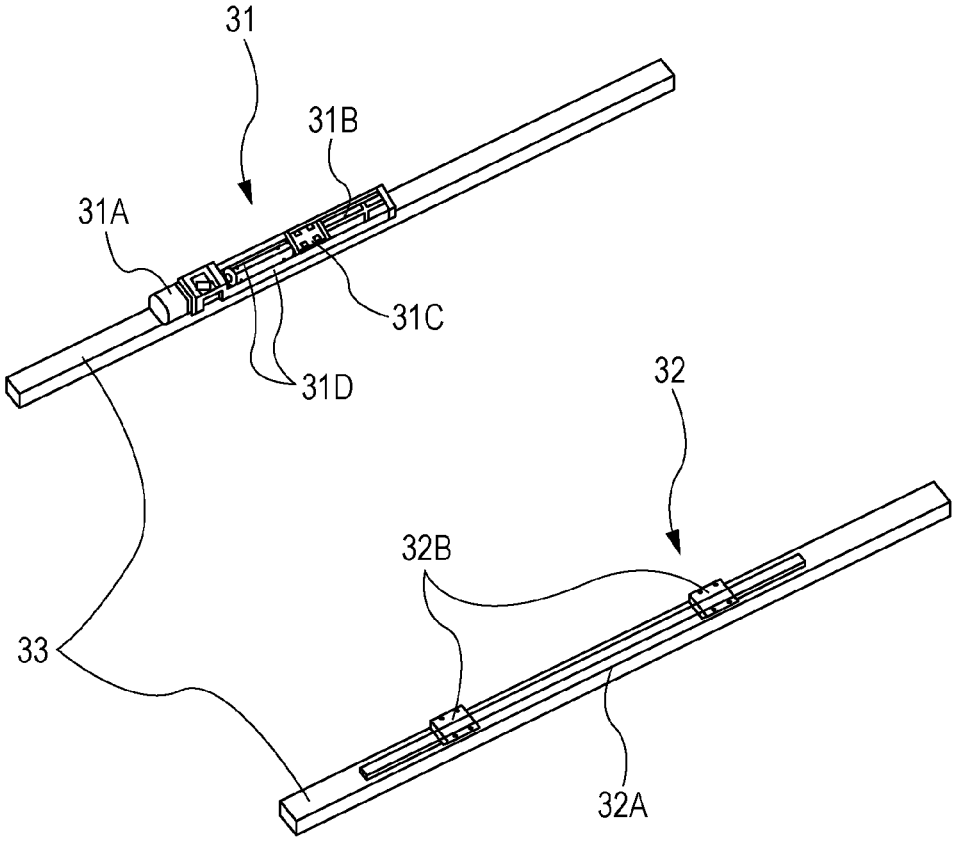
FIG. 6 is a configuration diagram of a Y-converting mechanism.

FIG. 6 is a configuration diagram of a Y-converting mechanism for moving the foregoing moving frame in the Y-direction. The Y-converting mechanism is provided on the two fixed frames 33 disposed in parallel along the Y-direction. The fixed frames 33 are fixed with reference to the fixed frames 78 of the recording apparatus. The Y-converting mechanism is constituted by a linear actuator 31 (driving side) provided at one fixed frame 33 and a linear guide 32 (driven side) provided at the other fixed frame 33. The linear actuator 31 is constituted by a motor 31A, a ball screw 31B, a nut 31C, and a guide 31D. When the motor 31A rotates, the ball screw 31B connected to the motor 31A rotates to move the nut 31C straight. The nut 31C is fixed to the frame 14. The nut 31C moves straight accurately in the Y-direction by the guide of the guide 31D. The linear guide 32 is constituted by a guide 32A and tables 32B. The tables 32B move straight freely in the Y-direction. The tables 32B are fixed to the frame 15. The linear actuator necessarily employs the ball nut mechanism but may employ a linear motor. This configuration makes it possible to move the moving frame constituted by the frames 14 and 15 and the joint portions 16A and 16B, that is, the head holder 3, move straight along the Y-direction when the motor 31A of the linear actuator 31 is driven. Thus, the head holder 3 can be displaced in the Y-direction and the Z-direction by the displacement mechanism 2.

Figure 7A:
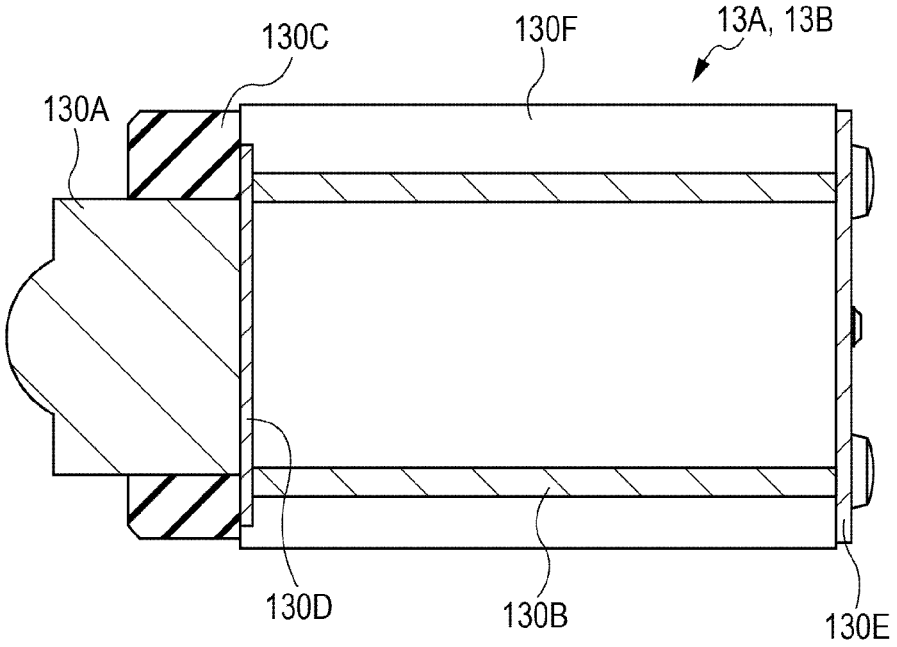
FIG. 7A is an enlarged view of an elastic portion in a normal state.
Figure 7B:
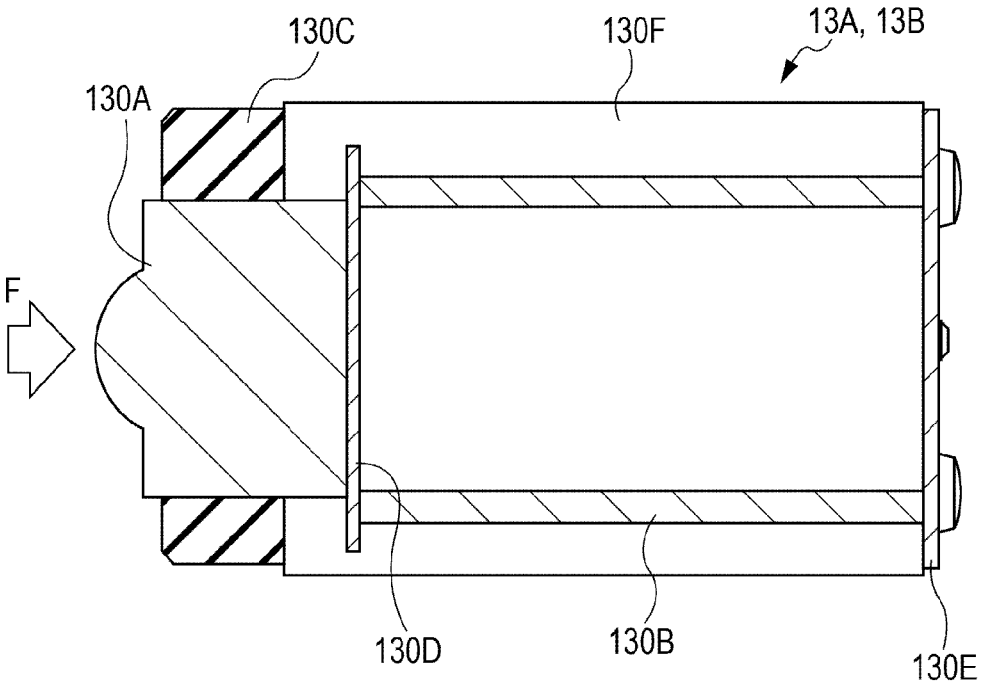
FIG. 7B is an enlarged view of an elastic portion in a deformed state.

FIGS. 7A and 7B are enlarged diagrams of the elastic portion 13A (13B) provided at the head holder 3. FIG. 7A illustrates a normal state, and FIG. 7B illustrates a deformed state due to an external force F. The elastic portion 13A (13B) includes a contact portion 130A that is a rolling bearing and springs 130B that are elastic members that expand and contract in the Y-direction. The elastic members may not necessarily be springs but may be another elastic member, such as rubber, provided that it has elasticity. The elastic portion 13A (13B) further includes a guiding member 130C that guides displacement of the contact portion 130A, plates 130D and 130E provided either side of the springs 130B, and a body 130F that integrally holds the guiding member 130C and the plate 130E. As shown in FIG. 7B, when the external force F is given to the contact portion 130A in the direction in which the spring 130D is compressed, the contact portion 130A and the plate 130D are displaced straight. The spring 130D is compressed by the movement of the contact portion 130A. The contact portion 130A comes to rest at a position at which the external force F and the spring pressure (elastic force) due to the compression of the springs 130B are equally balanced. When the application of the external force F ceases, the contact portion 130A returns to the standard position in FIG. 7A by the force of the spring 130D.

Next, the operation of positioning by displacing the head holder 3 (recording head units 5) will be described. The head holder 3 is positioned in the X-direction, the Y-direction, and the Z-direction with respect to the reference portion provided with the same reference as that of the fixed portion of the conveying mechanism 4. For the Y-direction, the head holder 3 can be selectively positioned at a desired position of a plurality of positions.

Figure 8:
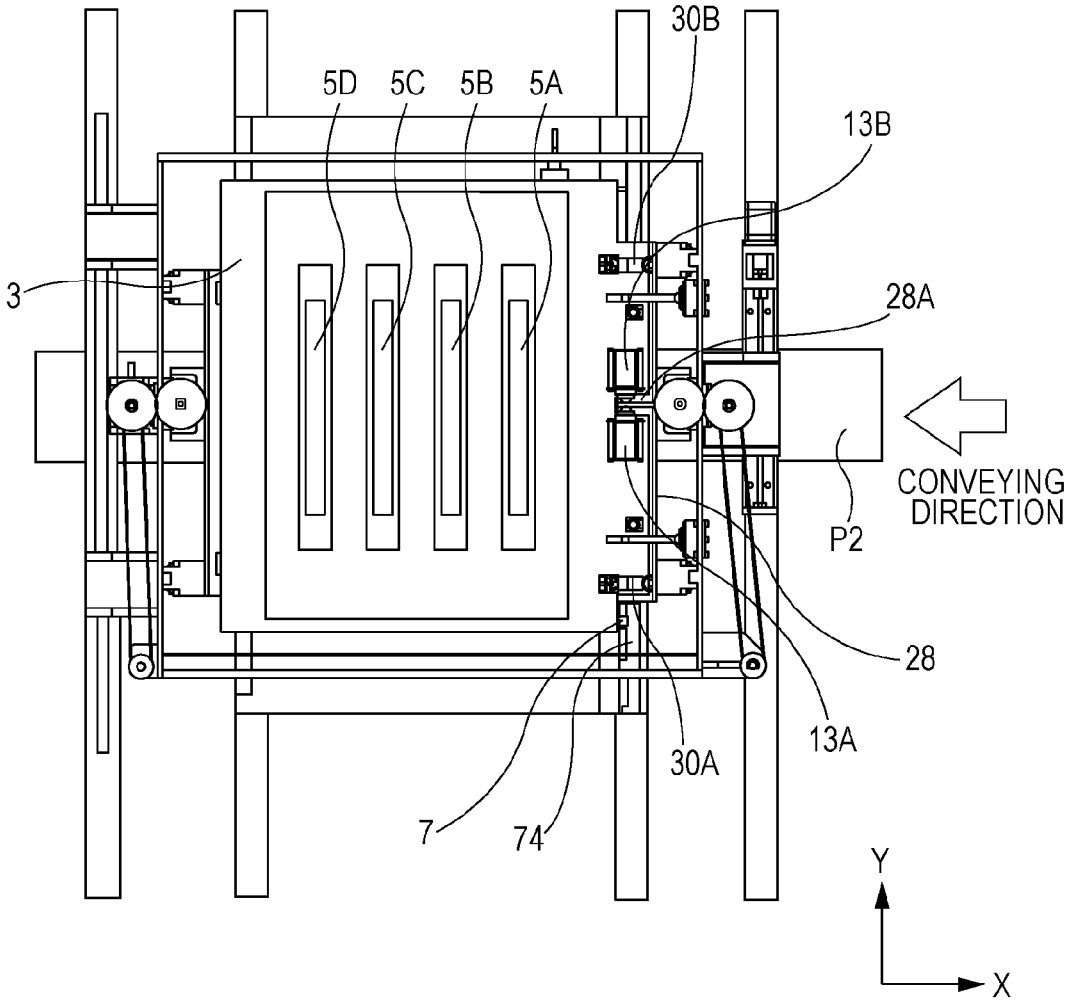
FIG. 8 is a top view of the head holder, illustrating an example of the positional relationship in the Y-direction between the head holder and a sheet.

FIG. 8 is a top view of the head holder 3 located at a standard position in the Y-direction. The center of a sheet P2 being conveyed and the center of the nozzle arrays of the recording head units 5 are aligned in the Y-direction. Springs 30A and 30B are interposed between the Z-arm 28 and the head holder 3 to exert a tensile force therebetween. That is, the head holder 3 comes into contact with the Z-arm 28 and is urged to be positioned in the X-direction. A plate 28A of the Z-arm 28 is placed between the two elastic portions 13A and 13B that are fixed along the Y-direction to the upper surface of the head holder 3. The plate 28A is sandwiched without a gap between the two elastic portions 13A and 13B. The rib 7 of the head holder 3 is inserted into central one of the plurality of depressions formed in the reference block 74, which is a reference of the apparatus, thereby being positioned in the Y-direction.

Figure 9:
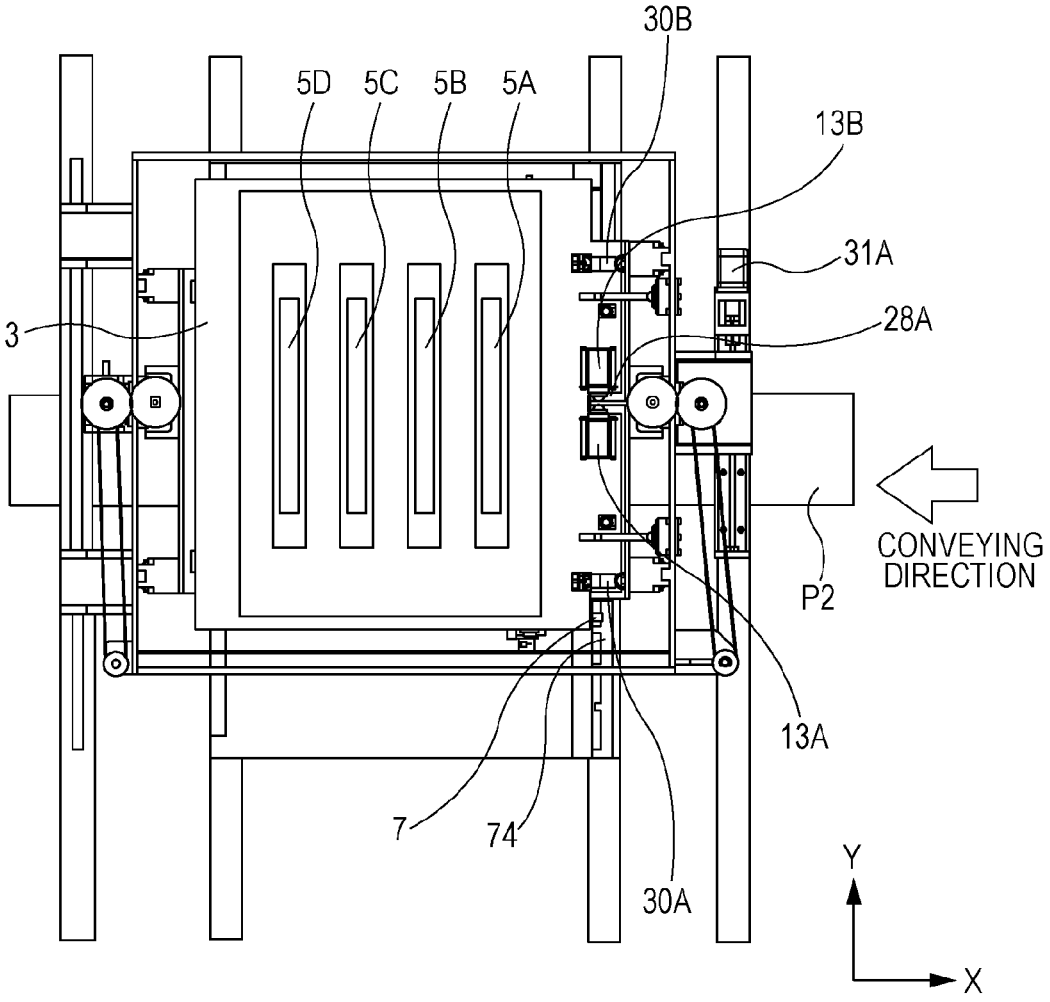
FIG. 9 is a top view of the head holder, illustrating an example of the positional relationship in the Y-direction between the head holder and a sheet.

FIG. 9 is a top view of the head holder 3 located at a position displaced in the Y-direction from the standard position. The center of the sheet P2 and the center of the nozzle array of the recording head units 5 are not aligned in the Y-direction. The rib 7 of the head holder 3 is inserted into one of the depressions formed in the reference block 74, different from that in FIG. 8, to be positioned in the Y-direction.

Figure 10A:
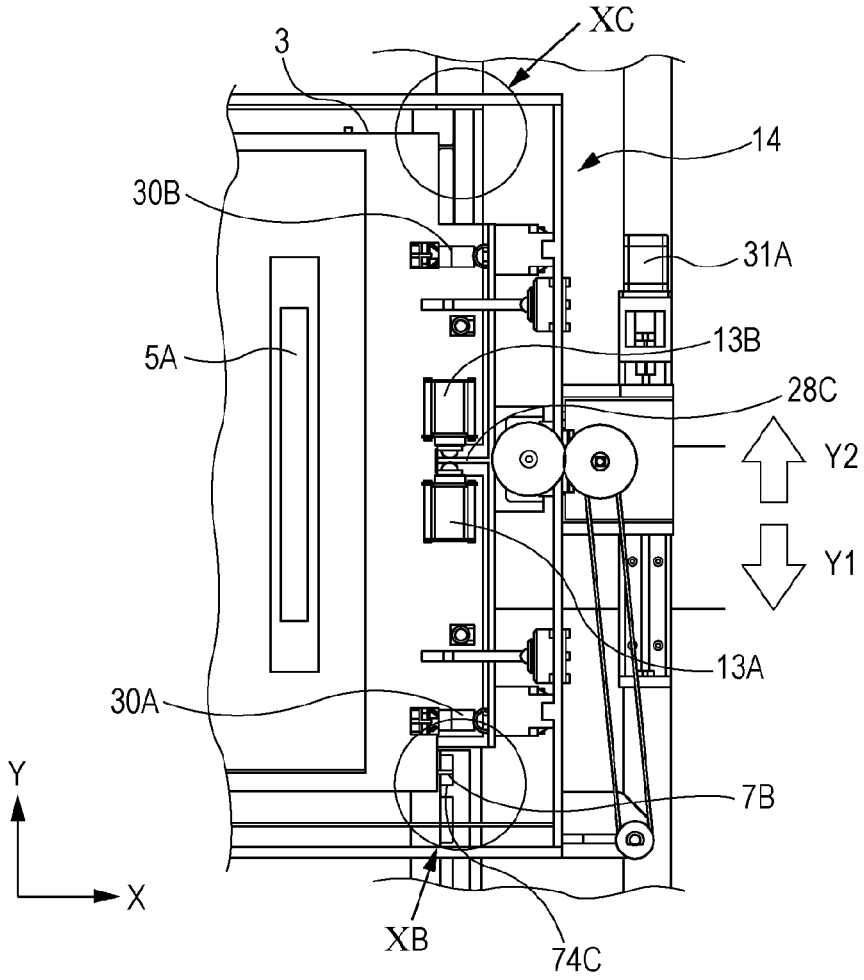
FIG. 10A is a diagram illustrating a state in which the head holder is positioned in a position in the Y-direction.
Figure 10B:
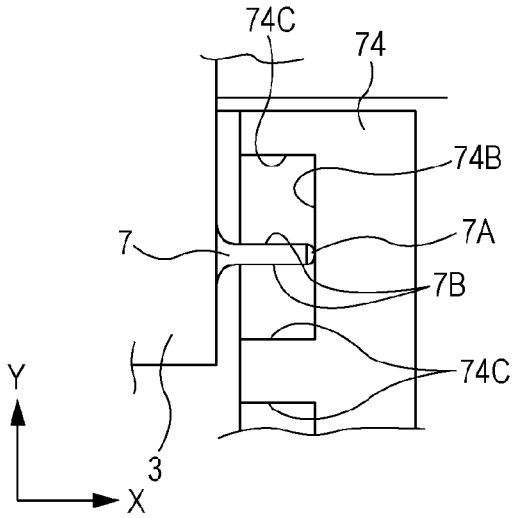
FIG. 10B is a diagram of portion XB in FIG. 10A.
Figure 10C:
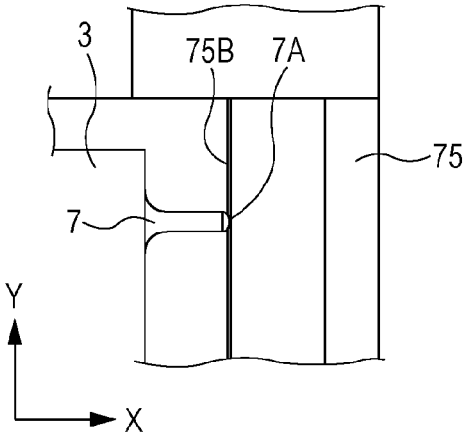
FIG. 10C is a diagram of portion XC in FIG. 10A.
Figure 11A:
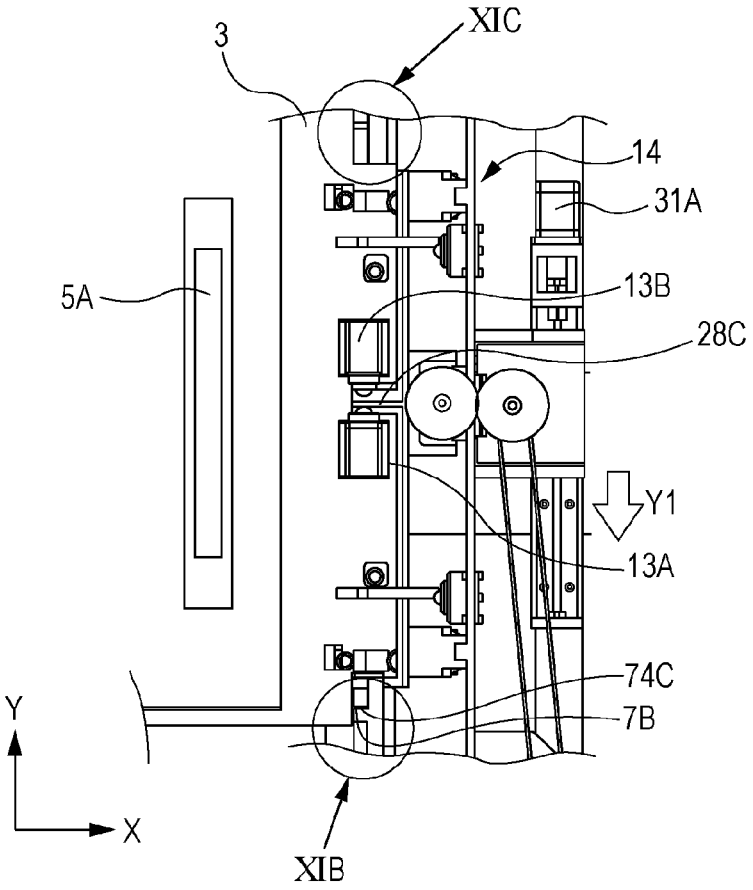
FIG. 11A is a diagram illustrating a state in which the head holder is positioned in a different position in the Y-direction.
Figure 11B:
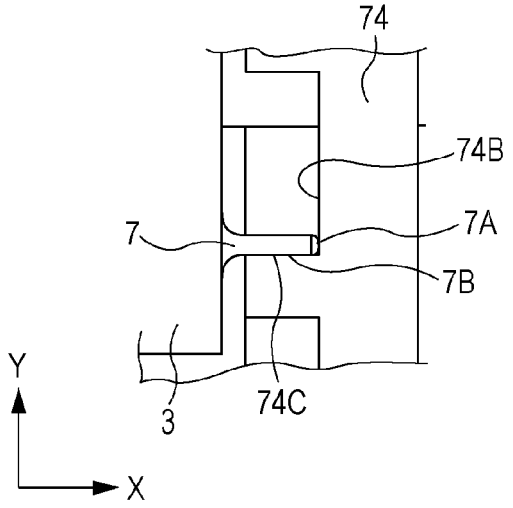
FIG. 11B is a diagram of portion XIB in FIG. 11A.
Figure 11C:
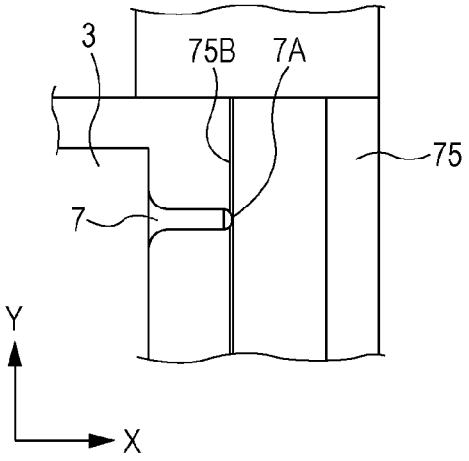
FIG. 11C is a diagram of portion XIC in FIG. 11A.
Figure 12A:
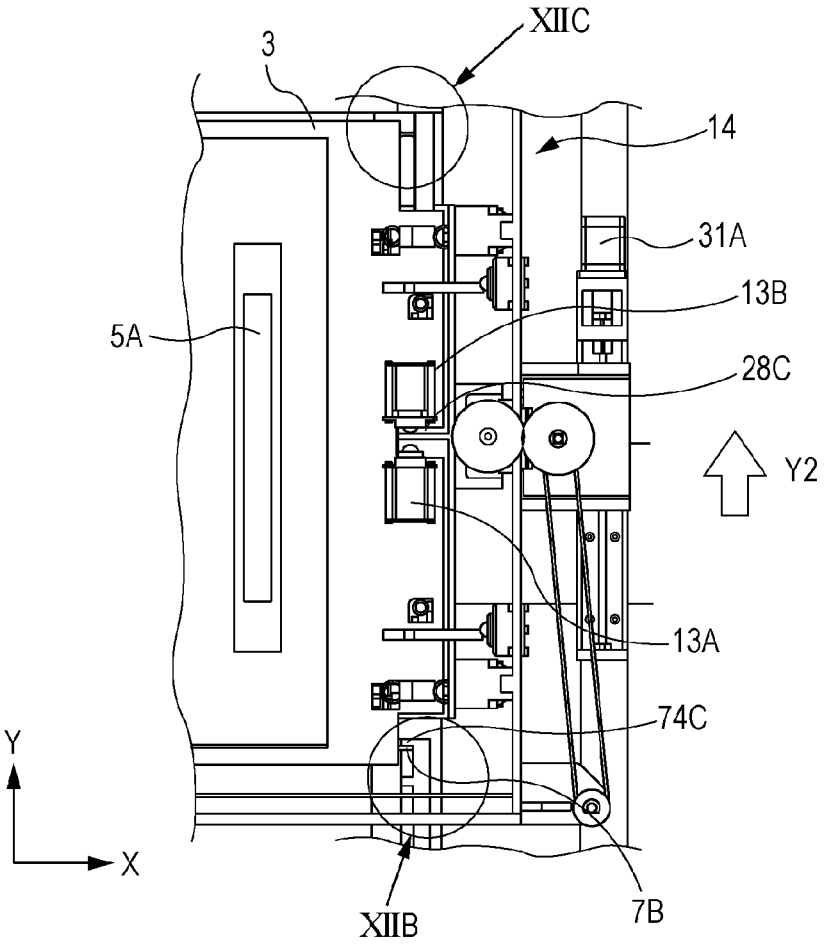
FIG. 12A is a diagram illustrating a state in which the head holder is positioned in a different position in the Y-direction.
Figure 12B:
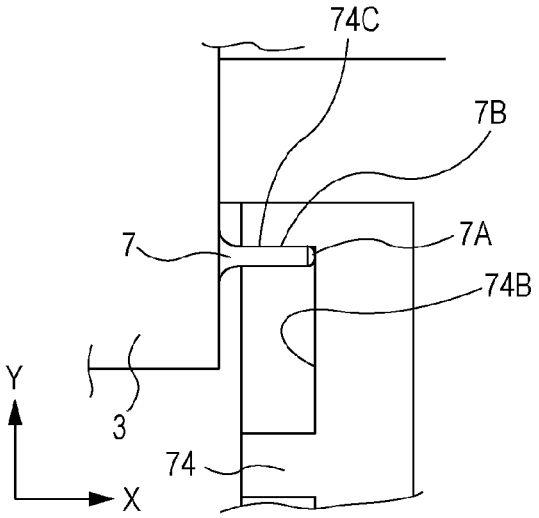
FIG. 12B is a diagram a diagram of portion XIIB in FIG. 12A.
Figure 12C:
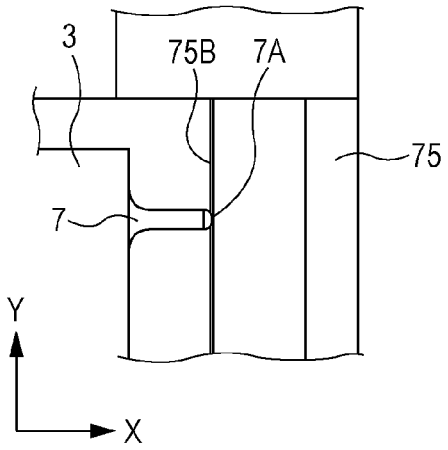
FIG. 12C is a diagram of portion XIIC in FIG. 12A.

FIGS. 10A to 10C, FIGS. 11A to 11C, and FIGS. 12A to 12C are diagrams illustrating positioning of the head holder 3 in different positions in the Y-direction. FIGS. 10A to 10C illustrate a state in which Y-directional positioning of the head holder 3 has not been completed; FIGS. 11A to 11C illustrate a state in which the head holder 3 is positioned by being displaced in a Y1-direction; and FIGS. 12A to 12C illustrate a state in which the head holder 3 is positioned by being displaced in a Y2-direction opposite to the Y1-direction.

As described above, the moving frame that supports the head holder 3 moves in the Y-direction by the driving of the motor 31A of the linear actuator 31. As the movement is continued, one of the Y-positioning surfaces 74C at both sides of a depression of the reference block 74 and the Y-surface 7B of one rib 7 of the head holder 3 comes into contact with each other (see FIG. 11B or FIG. 12B). The other rib 7 does not come in contact because no corresponding Y-positioning surface 74C is present (see FIG. 11C or FIG. 12C). When the linear actuator 31 is kept driven from this sate, the contact portion 130A of the elastic portion 13A or 13B is displaced so as to be pushed inside against the urging force of the springs 130B (see FIG. 11A or FIG. 12A).

When a preset pushing distance is reached by the control of the control unit, the rotational driving of the motor 31A is stopped. The rotation of the motor 31A is inhibited by a motor exciting force by exciting the motor 31A (stepper motor) to prevent the motor 31A from rotating even if an external force is exerted. Since the motor exciting force is larger than the elastic force (spring force) of the elastic portion 13A or 13B, the contact portion 130A of the elastic portion 13A or 13B does not return to its original position due to the urging force of the springs 130B while the motor 31A is kept excited. When the Y-directional positioning of the head holder 3 is to be cancelled, the motor 31A is rotated in a direction in which the spring force of the springs 130B is cancelled to thereby move the head holder 3 to the standard position shown in FIG. 12A, and thereafter the rotation of the motor 31A is stopped. After the head holder 3 is positioned, the motor 31A is kept excited to maintain the Y-directional positioning at least during image recording on the sheet. If the linear actuator 31 employs a ball screw mechanism, the motor 31A is not rotated by the spring force of the elastic portion 13A or 13B, the excitation control to inhibit the rotation of the motor 31A may be omitted.

The Y-directional positioning of the head holder 3 is thus performed by displacing the head holder 3 in the Y-direction against the urging force of the elastic portion 13A or 13B, and bringing the abutment portion of the head holder 3 into contact with one of the plurality of positioning surfaces of the reference portion. The head holder 3 is positioned and fixed in a state in which an urging force is exerted thereon by the elastic portion 13A or 13B. This ensures that the contact between the abutment portion and the positioning surface is maintained without rattle, thus maintaining accurate positioning without causing a deviation even if vibrations occur during image recording. Furthermore, since the rotation of the motor 31A is inhibited using the exciting force of the stepper motor, the urging force of the elastic portion 13A or 13B can be accurately maintained constant. The motor 31A may be replaced with a DC motor. In this case, the DC motor should be kept stopped at a predetermined position so as not to rotate under servo control.

Figure 13A:
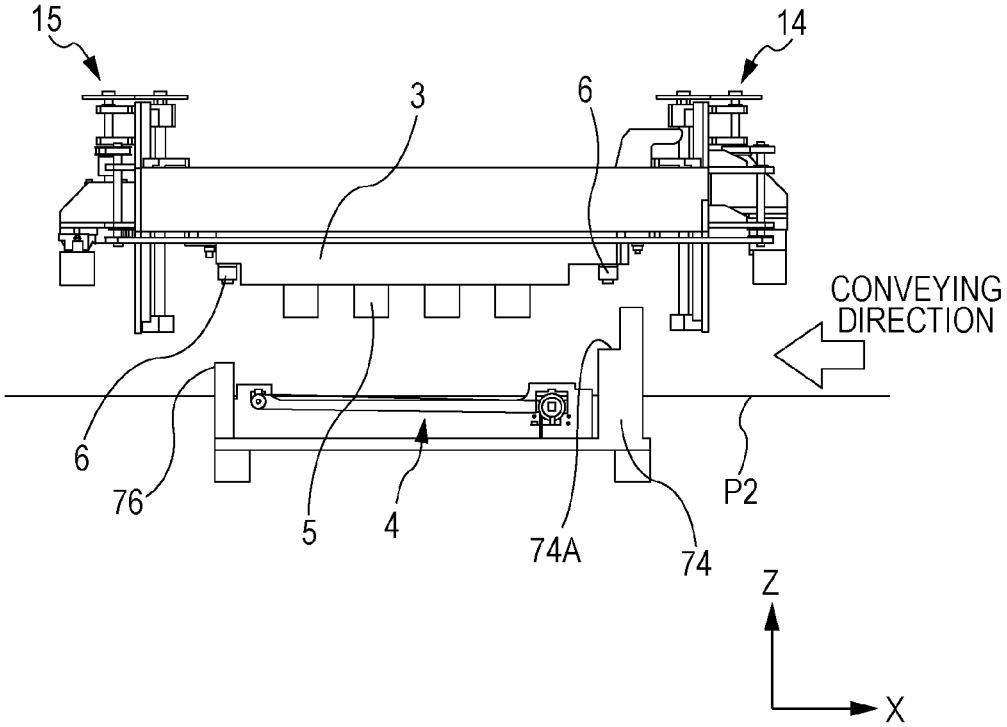
FIG. 13A is a diagram for describing the state transition of the head holder displaced in a Z-direction.
Figure 13B:
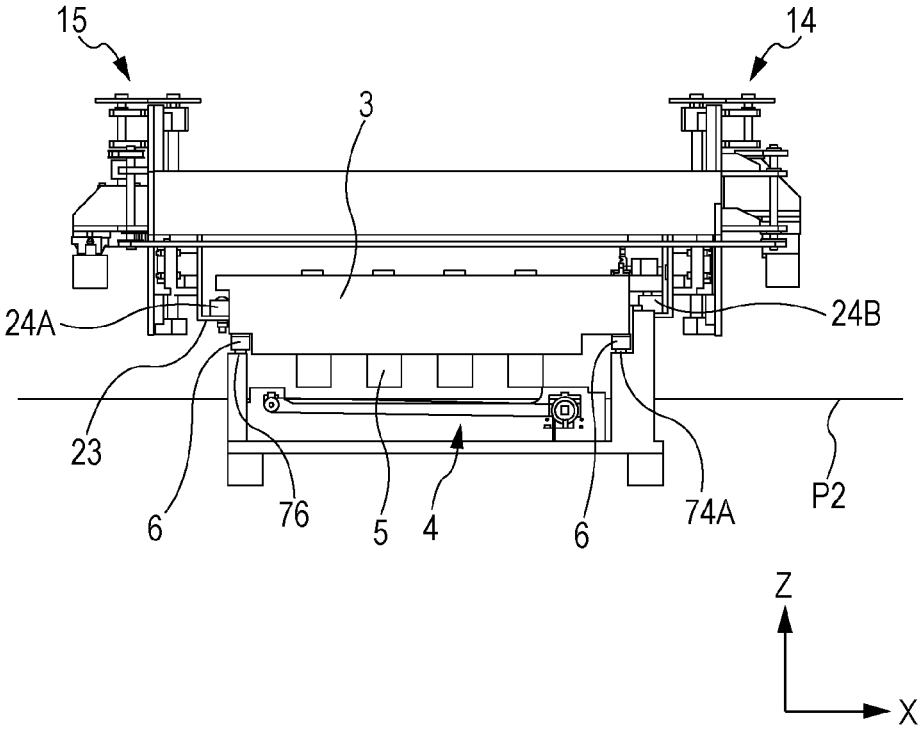
FIG. 13B is a diagram for describing the state transition of the head holder displaced in the Z-direction.

Next, z-direction positioning of the head holder 3 will be described. FIGS. 13A and 13B are diagrams for explaining state transition in Z-direction displacement. FIG. 13A illustrates a state in which the head holder 3 is retracted upward, and FIG. 13B illustrates a state in which the head holder 3 is displaced downward, so that the nozzles of the recording head units 5 and the sheet P2 are opposed at a gap suitable for recording (for example, 1 mm). As described above, when the motor 17 on the frame 15 is driven, the head holder 3 moves upward and downward via the Z-arms 23 and 28. When the head holder 3 moves downward, the four Z-bearings 6 provided on the lower surface of the head holder 3 come into contact with the Z-positioning surfaces 74A, 75A of the reference blocks 74 and 75 and the upper surfaces of the reference blocks 76 and 77 of the conveying mechanism 4, respectively. At the same time, the flat portions 11 and 12 (see FIG. 3B) of the lower surface of the head holder 3 come apart from bearings 24A and 24B of the Z-arms 23 and 28. Thus, the Z-direction positioning of the head holder 3 to the conveying mechanism 4 is completed. The positioning may be performed not by the contact but by controlling the downward moving distances of the Z-arms 23 and 28.

When the head holder 3 is moved downward in the Z-direction, the ends of the two ribs 8 of the head holder 3 come into contact with protrusions of the wall of the frame 14, so that the head holder 3 is retracted downstream in the X-direction against the urging force of the springs 30A and 30B. When the head holder 3 is further moved downward, the ribs 8 and the protrusions come out of contact to return the head holder 3 to its original position again due to the urging force of the springs 30A and 30B. When the head holder 3 returns to its original position, the X-surface 7A of the rib 7 comes into contact with the X-positioning surface 74B. That is, when the head holder 3 moves downward, the head holder 3 is temporarily displaced in the X-direction. The amount of X-directional displacement of the head holder 3 corresponds to a distance at which the end (X-surface 7A) of the rib 7 of the head holder 3 can move out of the inside of the depression into another depression.

In this way, the rib 7 is temporarily retracted out of one depression while the head holder 3 is moving upward or downward in the Z-direction. In this retracted state, the head holder 3 can be freely moved in a wide range in the Y-direction. Accordingly, for the Y-directional positioning, the head holder 3 is stopped halfway through the Z-directional movement and is then moved in the Y-direction to oppose the rib 7 to the vicinity of central one of the plurality of depressions. The head holder 3 is again moved in the Z-direction to move the rib 7 into the depression. This state is illustrated in FIG. 10B, in which the X-surface 7A of the rib 7 is in contact with the X-positioning surface 74B and thus the X-directional positioning is achieved. Thereafter, the head holder 3 is further moved in the Y-direction, as described above, to bring one of the Y-positioning surfaces 74C that are both sides of the depression into contact with the Y-surface 7B of the rib 7 of the head holder 3. Thus, as shown in FIG. 11B or FIG. 12B, the head holder 3 is finally positioned in the Y-direction and the X-direction.

As described above, since the reference block 74 has the plurality of depressions arranged along the Y-direction, and the depressions each have two Y-positioning surfaces 74C, the Y-directional positioning of the head holder 3 can be performed using any surface of the plurality of (the number of depressions×2) positioning surfaces. If Y-directional positioning is performed at two positions, only one depression is required.

A recording operation sequence of the thus-configured recording apparatus will be described. The sheet P1 in FIG. 2 is a sheet having a maximum size that the nozzle array of the recording head units 5 covers. In this case, all of the nozzle array is used in image recording, partial degradation of the nozzles hardly occurs. However, if a sheet that is narrower than that is frequently used, nozzle use frequency is unbalanced depending on the location. That is, since nozzles through which the sheet passes are used intensively, the life of nozzles that are frequently used becomes short, thus posing the possibility of recording failure of corresponding portions. Accordingly, this embodiment displaces the recording head units 5 in the sheet width direction (Y-direction) as desired to reduce unbalanced nozzle use frequency. An operation sequence therefor will be described below.

Figure 14:
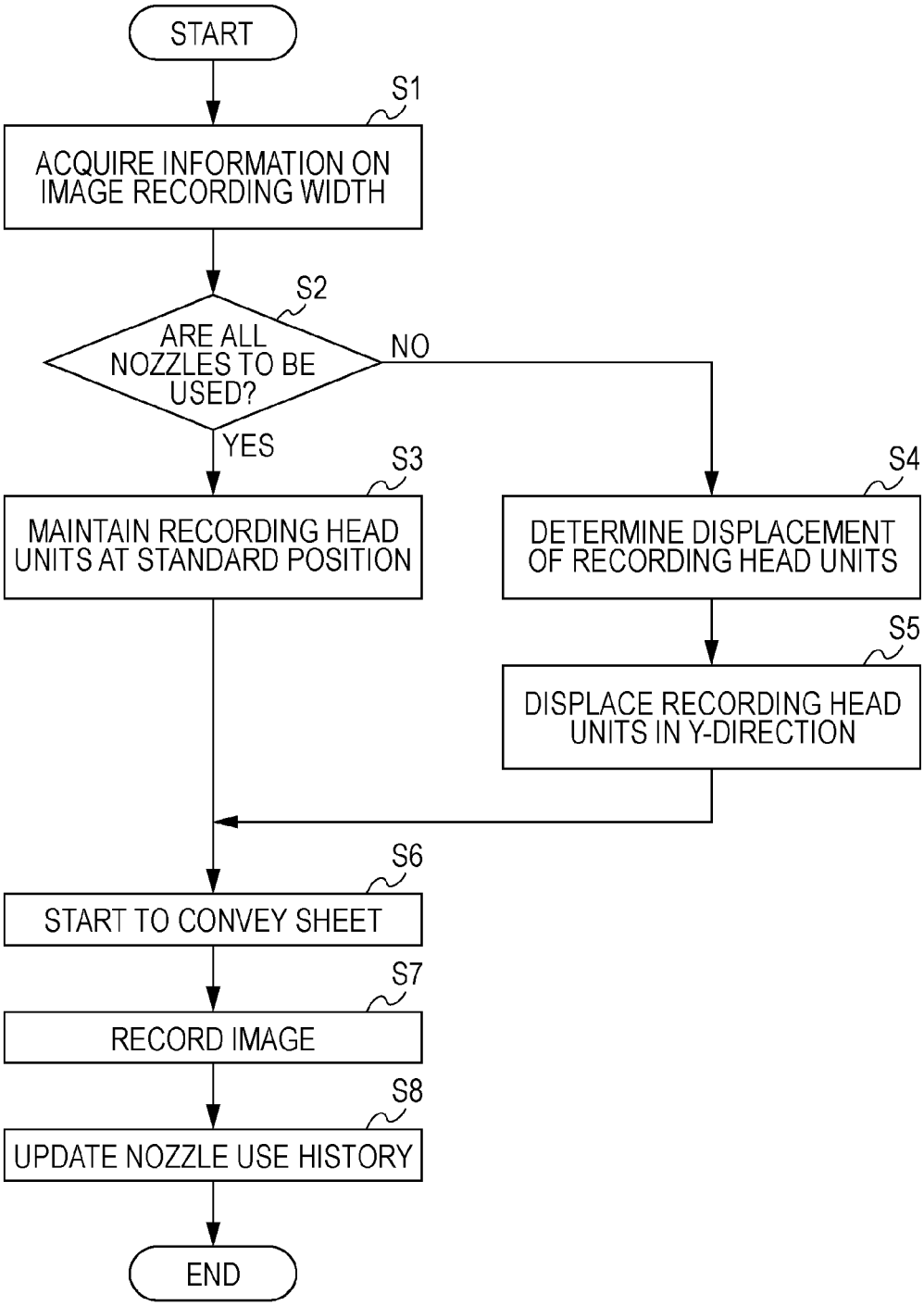
FIG. 14 is a flowchart illustrating the sequence of a recording operation.

FIG. 14 illustrates the operation sequence of the recording apparatus of this embodiment. This sequence is executed under the control of the control unit 107. Upon receiving a record instruction, the recording apparatus acquires information about an image recording width in step S1. An example of the information to be acquired is the size in the sheet width direction (the number of pixels) of image data to be recorded. Alternatively, the information may be either the size (standard size) of a roll sheet set in the sheet supply unit 101, which is input by the user, or a sheet size that is automatically recognized by a detection mechanism. In step S2, it is determined whether to use all the nozzles of the recording head units 5 in the sheet width direction from the information on the image recording width acquired in step S1 (Yes or No). If the determination is Yes, the process moves to step S3, and if the determination is No, the process moves to step S4.

In step S3, the recording head units 5 (head holder 3) are maintained at the standard position without being displaced. The process then moves to step S6. On the other hand, in step S4, a nozzle region to be used in recording is determined using the image recording width acquired in step S1 and use histories (use frequencies) of the individual nozzles in the whole nozzle region which are stored in the memory of the control unit 107. At the determination, a region is set in which a nozzle region included in the image recording width is less used. The amount of displacement in the Y-direction of the recording head units is determined so that the set nozzle region faces the sheet. In the next step S5, the recording head units are displaced in the Y-direction by the operation described above in accordance with the amount of displacement determined in step S4 and is fixed. The process moves to step S6.

In step S6, conveyance of the sheet is started by supplying the sheet from the sheet supply unit 101. At the start of recording, the recording head units are moved in the Z-direction to provide a predetermined recording gap by the foregoing operation. In step S7, an image is recorded using the set nozzle region. In step S8, the numbers of times the individual nozzles are used for image recording (the numbers of ink ejections) are counted, and the use history data in the memory is updated. The memory content in the memory is referred to at the next operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-113560 filed on May 17, 2010, which is hereby incorporated by reference herein in its entirety.

What is claimed is:

1. An apparatus comprising:

a conveying mechanism configured to convey a sheet in a first direction;

a line recording head in which nozzles are arrayed along a second direction intersecting the first direction;

a holder configured to hold the line recording head, the holder having a first abutment portion in the first direction, a second abutment portion in the second direction, and a third abutment portion in a third direction that is a direction of a gap between the nozzles and the sheet direction;

a displacement mechanism configured to displace the holder in the second direction and the third direction, the displacement mechanism having a fixed portion and a movable portion;

an elastic portion provided between the movable portion and the holder and configured to exert an urging force in the second direction; and a reference portion having a first positioning surface that can come into contact with the first abutment portion, a plurality of second positioning surfaces that differ in the second direction and that can come into contact with the abutment portion, and a third positioning surface that can come into contact with the third abutment portion, wherein when the line recording head is to be positioned in the second direction, the holder is displaced in the second direction against the urging force of the elastic portion using the displacement mechanism to bring the abutment portion into contact with one of the second positioning surfaces, thereby positioning and fixing the holder to the reference portion, with the urging force exerted thereto.

2. The apparatus according to claim 1, wherein the third abutment portion includes a rolling bearing.

3. The apparatus according to claim 1, wherein the holder is configured such that the first abutment portion is temporarily retracted from the first positioning surface halfway through displacing the holder in the third direction by the displacement mechanism, and the holder is displaced in the second direction, with the first abutment portion retracted from the first positioning surface.

4. The apparatus according to claim 3, wherein the reference portion has a plurality of depressions along the second direction, the first positioning surface is an inner bottom of each of the plurality of depressions, and the plurality of the second positioning surfaces are inner sides of the plurality of depressions;

the holder is displaced in the third direction to retract the first abutment portion from the first positioning surface; in this state, the holder is displaced in the second direction to oppose one of the plurality of depressions to the first abutment portion; the holder is again moved in the third direction to bring the first abutment portion into the depression; and thereafter, the holder is moved in the second direction to bring the second abutment portion into contact with one of the second positioning surfaces.

5. The apparatus according to claim 1, wherein the reference portion is provided on a fixed portion of the conveying mechanism.

* * * * *